US009108219B2

(12) United States Patent
Grosso et al.

(10) Patent No.: US 9,108,219 B2
(45) Date of Patent: Aug. 18, 2015

(54) METHOD FOR DEPOSITING A LAYER ON THE SURFACE OF A SUBSTRATE

(75) Inventors: David Grosso, Cheptainville (FR); Cédric Boissiere, Villebon sur Yvette (FR); Clément Sanchez, Bure sur Yvette (FR); Pierre Antoine Albouy, Paris (FR)

(73) Assignees: UNIVERSITE PIERRE ET MARIE CURIE (PARIS 6), Paris (FR); CENTRE NATIONAL DE LA RECHERCHE SCIENTIFIQUE, Paris (FR); SCIENTIFIQUE, UNIVERSITE PARIS-SUD 11, Orsay Cedex (FR)

( * ) Notice: Subject to any disclaimer, the term of this patent is extended or adjusted under 35 U.S.C. 154(b) by 269 days.

(21) Appl. No.: 13/810,054

(22) PCT Filed: Jul. 12, 2011

(86) PCT No.: PCT/EP2011/061850

§ 371 (c)(1),
(2), (4) Date: Feb. 11, 2013

(87) PCT Pub. No.: WO2012/007459

PCT Pub. Date: Jan. 19, 2012

(65) Prior Publication Data

US 2013/0171356 A1 Jul. 4, 2013

(30) Foreign Application Priority Data

Jul. 16, 2010 (FR) ..... 10 55821

(51) Int. Cl.

| | |
|---|---|
| ***B05C 3/00*** | (2006.01) |
| ***B05D 1/18*** | (2006.01) |
| ***B05D 3/04*** | (2006.01) |

(52) U.S. Cl.
CPC ..... *B05D 1/18* (2013.01); *B05D 3/0486* (2013.01); *B05D 3/0473* (2013.01); *B05D 2203/35* (2013.01)

(58) Field of Classification Search
CPC ..... B05D 1/18; B05C 3/02
USPC ..... 427/331, 372.2, 430.1; 118/421, 429
See application file for complete search history.

(56) References Cited

U.S. PATENT DOCUMENTS 3,589,330 A * 6/1971 Alexeff ..... 118/688
3,638,605 A * 2/1972 Grandgirard ..... 118/50.1

(Continued)

FOREIGN PATENT DOCUMENTS

FR 1 357 990 A 4/1964
GB 1 251 418 A 10/1971

(Continued)

OTHER PUBLICATIONS

International Search Report for PCT/EP2011/061850 dated Oct. 14, 2011.

*Primary Examiner* — Cachet Sellman
(74) *Attorney, Agent, or Firm* — Sughrue Mion, PLLC

(57) ABSTRACT

A process for depositing a layer on at least part of the surface of a substrate by at least partially submerging the substrate in a solution having a solvent and at least one compound intended to form the layer, then drying the substrate, the drying being at least partially carried out in an atmosphere that is isolated from the solution. The submersion in the solution and the drying of the substrate are carried out in the same controlled-atmosphere enclosure.

14 Claims, 1 Drawing Sheet

(56) References Cited

U.S. PATENT DOCUMENTS

| | | | | |
|---|---|---|---|---|
| 3,659,550 | A * | 5/1972 | Fulton | 118/702 |
| 4,549,502 | A * | 10/1985 | Namdari | 119/664 |
| 5,009,933 | A * | 4/1991 | Matsuda et al. | 427/287 |
| 2007/0092657 | A1 * | 4/2007 | Ferguson et al. | 427/421.1 |
| 2009/0252880 | A1 * | 10/2009 | Kurth | 427/372.2 |

FOREIGN PATENT DOCUMENTS

| | | | |
|---|---|---|---|
| WO | 93/11079 | A1 | 6/1993 |
| WO | WO 9311079 | A1 * | 6/1993 |

* cited by examiner

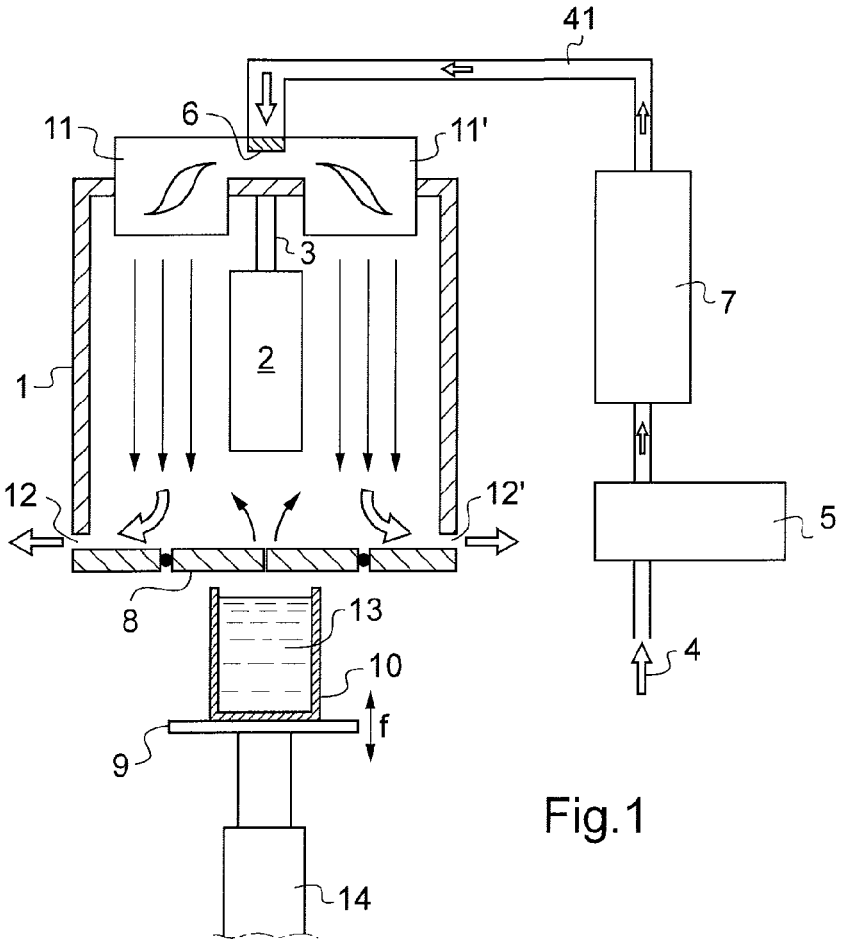
Fig.1
Fig.2a
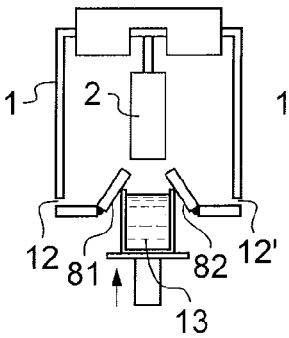
Fig.2b
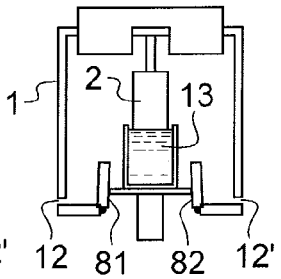
Fig.2c
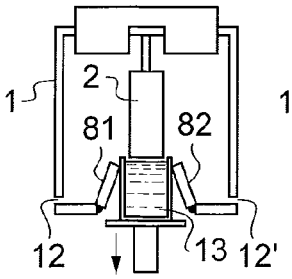
Fig.2d
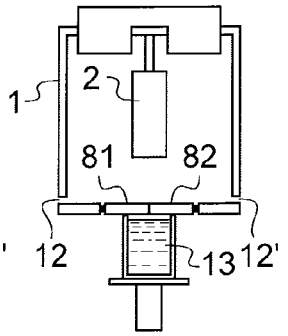

METHOD FOR DEPOSITING A LAYER ON THE SURFACE OF A SUBSTRATE

CROSS REFERENCE TO RELATED APPLICATIONS

This application is a National Stage of International Application No. PCT/EP2011/061850 filed Jul. 12, 2011, claiming priority based on French Patent Application No. 1055821 filed Jul. 16, 2010, the contents of all of which are incorporated herein by reference in their entirety.

The invention relates to a process for depositing a layer on at least part of the surface of a substrate.

BACKGROUND OF THE INVENTION

It is known to deposit a layer on at least part of the surface of a substrate by bringing said surface into contact with a liquid phase generally containing one or more compounds in suspension or dissolved in a solvent, or a sol-gel phase. This contact may be made by coating the substrate with a liquid phase, or submerging the substrate in a liquid phase, or even by passing the substrate under a liquid-phase curtain. The layer is then formed by evaporating the solvent from the surface of the substrate, this evaporation possibly being followed by one or more treatments of the layer being formed, such as a heat treatment, in order to react/convert/harden the compounds or at least superficially modify the layer being formed, and thus obtain a layer with the desired composition and properties. Spin coating and dip coating are two known examples of this type of technique.

It will be understood that, with this type of deposition technique, control of the thickness, uniformity and, more generally, the quality of the layer, is difficult because it depends on many parameters. Specifically, especially when it is chosen to submerge the substrate in a solution, the thickness of the final layer obtained depends on the speed with which the substrate is withdrawn from the solution; however, controlling the various parameters of this type of deposition (speed at which the substrate is withdrawn from the solution, temperature conditions, etc.) is not always enough to completely controt the properties of the layer.

A process for depositing a layer on a substrate is known from document WO 93/11079, in which the step of submerging the substrate takes place in a first enclosure and the step of evaporating the solvent from the surface of the substrate takes place in a second enclosure, the two enclosures being separated by a wall and an isolating element. In this way, the evaporation of the solvent is carried out in an atmosphere that is isolated from the solution, the solution remaining in the first enclosure.

However, it is necessary to move the substrate from one enclosure to another, through the isolating element, thereby tending to impede or alter drying of the layer.

AIM OF THE INVENTION

The aim of the present invention is to overcome the drawbacks of the aforementioned techniques for depositing a layer by providing a novel deposition process and a novel deposition device that especially allow control of the properties of the layers obtained using them to be further improved.

BRIEF DESCRIPTION OF THE INVENTION

One subject of the invention is a process for depositing a layer on at least part of the surface of a substrate by at least partially submerging the substrate in a solution comprising a solvent and at least one compound intended to form the layer, then drying the substrate, this drying being carried out at least partially in an atmosphere that is isolated from the solution. According to the invention, the submersion in the solution and the drying of the substrate are carried out in the same controlled-atmosphere enclosure.

The term "compound" is understood, within the context of the invention, to mean one or more nonvolatile compounds that, once dried and optionally treated, will become major constituents of the layer, optionally after chemical conversion and/or reaction together.

Specifically, it has been found that the drying period of the deposition process, i.e. the period corresponding to the evaporation of the solvent (and possibly certain other components of the solution) has a definite influence on the properties of the layer obtained: evaporation of the solvent from the liquid phase deposited on the surface of the substrate, in the absence of particular precautions, competes with natural evaporation of the solvent from the solution in which the substrate was submerged if, once the substrate is withdrawn from the solution, the solution remains in the same atmosphere as the drying substrate. This drawback is further aggravated when the solution remains in a given atmosphere confined in an enclosure. This is because solvent evaporating from the solution modifies the saturated vapor pressure of the atmosphere in which the substrate is located, and impedes/alters the evaporation of the solvent originating from the drying substrate.

The inventors, on account of the above effect, have found a way to isolate the drying substrate from the solution in which it was previously submerged, so as to eliminate this difficultly controllable competition, or at the very least limit it to a very short lapse of time. Thus, with this precaution, the drying of the layer by evaporation of the solvent that it contains is clearly better controlled, the vapor tension of the solvent in the atmosphere in which the substrate is located being a result only of the quantity of solvent evaporated from the layer being formed. Furthermore, if the deposition of the layer is carried out in a closed enclosure, it is then possible to closely control the composition of the atmosphere of the enclosure, to control the variation thereof, for example to gradually remove solvent vapor or to add, to the atmosphere of the enclosure, volatile compounds that will act on the composition of the layer, without it also being necessary to take into consideration solvent vapor originating from the solution.

Now, rapidly withdrawing the substrate from the solution so as to place it in a controlled-atmosphere enclosure temporarily exposes the substrate to open air and this impedes or modifies the drying of the layer. Advantageously, by keeping the substrate in the same enclosure, it is possible to better control removal of the solvent originating from the layer being formed, or even to modify the chemical composition or the physicochemical properties of the layer by modifying the parameters of this atmosphere (temperature, composition, etc.).

Specifically, according to a preferred embodiment of the invention, the solution is introduced into the controlled-atmosphere enclosure in order to allow the substrate to be submerged, and is removed from the controlled-atmosphere enclosure during the drying of the substrate. For example, the solution is contained in a moveable tank so as to be introduced into the enclosure and removed from the latter, especially by moving the tank in translation relative to the enclosure.

It may also be envisioned to move the enclosure relative to the solution. It may also be envisioned not to place the substrate in an enclosure during its submersion and its drying and to contain the solution in a tank equipped with a system for closing it, such as a cover, to prevent evaporation of the volatile compounds, which the solution may comprise, between two substrate submersions.

Preferably, the atmosphere in the enclosure is controlled by arranging for a flow of gas to pass through the interior of said enclosure.

The gas may optionally be inert, it may have properties that modify those of the layer being formed, for example it may have reducing or oxidizing properties, be acidic or basic, or be at a temperature that particularly influences the composition of the layer being formed.

Provision may be made for the through-flow of gas to be heated, especially before it enters the controlled-atmosphere enclosure. Provision may also be made to heat the interior of the chamber directly, the latter then comprising heating elements such as resistive heaters or circuits for flowing heat-transfer fluid.

The heating may be moderate, from 50 to 100° C. for example, in order to accelerate removal of an organic or aqueous solvent. It may also be chosen to heat the gas flow to a temperature that is clearly much higher (up to a few hundred degrees Celsius), directly, or in a second step after most of the solvent has been evaporated, in order, especially, to harden the layer.

One or more treatments may be carried out on the layer, in the enclosure, before, during and/or after complete drying, especially a chemical-vapor treatment and/or high-temperature treatment. The composition of the treated layer before, during and/or after drying will depend on the composition of the controlled atmosphere and on the chemical exchanges between layer and atmosphere. These exchanges are governed by condensation/evaporation equilibria, which equilibria exist for all known chemical species.

Another subject of the invention is a device for implementing the process described above, and which comprises:

- an enclosure;
- means for holding the substrate inside the enclosure;
- means for introducing the solution into the enclosure and removing said solution therefrom; and
- means for controlling the atmosphere inside the enclosure.

The means for introducing and removing the solution may also comprise:

- a tank for receiving the solution, said tank being moveably mounted relative to the enclosure so as to enter therein and exit therefrom; and
- means for passing the tank through the wall of the enclosure in order to allow the tank to enter and exit via these passing means.

The passing means may advantageously comprise at least one trap door that is pushed open by the tank during the introduction of the tank into the enclosure and that automatically closes during the removal of the tank.

This may be achieved in a purely mechanical way, the walls of the tank bearing against a trap-door of the enclosure and causing it to open, the trap-door closing again, for example, simply under the effect of gravity or via springback. An automatic system may also be envisioned, this system for example using sensors to detect the presence of the tank in the immediate vicinity of the opening means of the enclosure.

Another subject of the invention is the use of the process or the device described above to form metal oxide, oxynitride or oxycarbide and/or silica sol-gel layers, or even organic or silicided layers, the thicknesses of the layers possibly ranging from a few nanometers to several microns. The substrates to which the invention may be applied may also be very varied in nature: they may be flat or curved, for example made of glass, the layer being deposited on one of the faces or on all of the faces of this type of substrate. The deposition process of the invention is particularly suitable for completely covering three-dimensional substrates. Layers may be deposited in order to give the substrates various properties, especially optical or mechanical properties, or even to coat products in the food processing or drug delivery fields.

BRIEF DESCRIPTION OF THE DRAWINGS

Other features and advantages of the invention will become more clearly apparent in light of the following description and the appended drawings, illustrating a nonlimiting embodiment of the invention.

In the following, reference is made to the appended schematic drawings, in which:

FIG. 1 shows a cross-sectional view of a device according to the invention; and FIGS. 2*a*, 2*b*, 2*c*, 2*d* show steps of the deposition of a layer on a substrate using the device shown in FIG. 1.

These figures are purposefully very schematic and for the sake of legibility the various components shown have not been drawn to scale; each element shown has been given the same reference in all the figures.

DETAILED DESCRIPTION OF THE FIGURES

FIG. 1 shows a device according to the invention comprising an enclosure, here an evaporation chamber 1 bounding a substantially parallelepiped-shaped internal housing. The evaporation chamber 1 contains a substrate 2 on which it is desired to deposit a layer, the substrate being fixed to the upper internal wall of said chamber by holding means 3 known per se and which will not be described in detail here.

The device comprises means for controlling the internal atmosphere of the enclosure. Specifically, a flow of gas 4 passes through the evaporation chamber 1, the flow of gas 4 being controlled by the control means and conveyed by a pipe 41 into the top part of the chamber 1.

Here, the control means comprise a mass flow controller 5 and a shower head 6. The flow rate of the gas flow 4 is thus controlled using the controller 5, and arrives in the chamber via two inlets 11, 11' after passing through the shower head 6. The shower head 6 allows the flow of gas 4 entering the chamber 1 to be evenly distributed and homogenized, the flow of gas 4 then flushing the entire chamber 1 with a downward movement from the upper wall toward the lower part of the chamber 1 where it is evacuated via two lateral outlets 12, 12'.

According to one preferred embodiment, the flow of gas 4 is heated before it enters the evaporation chamber 1. For this purpose, the control means comprise a heating module 7 comprising a series of resistive heaters. The heating is achieved by passing the pipe 41 transporting the gas 4 through the heating module 7. The heating module 7 may be turned off or turned on and can be adjusted allowing the gas 4 to reach temperatures of, for example 50 to 500° C.

The device according to the invention also comprises means for introducing a solution 13 into the enclosure and for removing said solution therefrom. Specifically, the introducing means comprise means for passing the solution through the wall of the enclosure so as to allow the solution to enter and exit via these passing means. According to a particular embodiment, the passing means comprise a trap-door 8 that blocks an aperture formed in the lower wall of the evaporation chamber 1, the trap-door 8 opening upward as indicated by the arrows. This trap-door consists of two shutters 81, 82 (which will be more easily seen in FIGS. 2*a* to 2*d*) hinged on two of their opposed edges, so that in the closed position, the two shutters together seal the lower wall of the chamber 1 in the aperture. The edges of the shutters 81, 82 may be equipped with seals over all or some of their extent.

The introducing means also comprise a tank 10 containing the solution 13, which tank is mounted on a platform 9 placed under the evaporation chamber 1. The platform 14, and therefore the tank 10, can be moved using motorized means 14, for example here a telescopic cylinder the barrel and rod of which may be seen. The motorized means 14 allow the platform 9 and the tank 10 to be moved vertically upward and downward (as indicated by the arrow f), so that the tank 10 can be introduced into the evaporation chamber 1 via the trap-door 8. FIG. 1 illustrates a stage when the tank 10 is located outside the evaporation chamber 1.

Details of an example of a deposition process according to the invention using this device are given below using FIGS. 2*a* to 2*d*.

In this example, the flow of gas 4 is a flow of an inert gas, such as nitrogen or argon, introduced under pressure, via the inlets 11, 11', into the evaporation chamber 1. The substrate 2 is a sheet of glass and here is intended to be covered with an $SiO_2$ sol-gel layer. The means 3 for holding the substrate 2 at the upper internal wall of the enclosure here comprise a connecting and fastening rod. The platform 9 is placed under the evaporation chamber 1 and bears the tank 10, which contains a solution 13 of compounds (silicon alkoxide, hydrochloric acid and water) in a solvent, here ethanol.

The first step of the deposition process corresponds to FIG. 2*a*: the tank 10 and the platform 9 begin an upward vertical movement in translation under the control of the motorized means 14 in the direction of the trap-door 8 of the evaporation chamber 1, so that the upper edge of the tank 10 pushes the trap-door 8 of the chamber. The trap-door 8, under the effect of the pressure exerted by the edge of the tank 10, gradually opens as two shutters 81, 82, allowing the platform 9 and the tank 10 to enter the evaporation chamber 1.

The second step corresponds to FIG. 2*b*: the upward movement of the tank 10 is stopped when the substrate 2, placed in line with the trap-door 8, is submerged in the solution 13 to the desired depth. The two shutters 81, 82 of the trap-door 8 are then at their most open. It will be observed that the relative position and the size of the substrate 2, of the trap-door 8 and of the sidewalls of the tank 10 are such that, in this position, the sidewalls of the tank 10 make contact with the edges of the shutters 81, 82 so as, together, to seal the lower wall of the chamber 1 to a certain extent.

The third step corresponds to FIG. 2*c*: the platform 9 and the associated tank 10 begin, under the control of the motorized means 14, a downward movement in translation, so that the substrate 2 re-emerges from the solution 13, a film of the solution remaining on the surface of the previously submerged substrate 2, and so that the tank 10 gradually exits the evaporation chamber 1 allowing the shutters 81, 82 to close on each other simply under the effect of gravity.

The fourth step corresponds to FIG. 2*d*: the trap-door 8 is completely closed, the platform 9 and the associated tank 10 are completely outside the evaporation chamber 1. This is the step of drying the film of solution deposited on the surface of the substrate 2. The evaporation of the solvent from the film of solution results in a thin layer being obtained on the surface of the substrate 2, said thin layer having a thickness of between 20 and 1000 nm depending on the speed with which the substrate 2 was removed from the solution 13. Said thin layer then consists of weakly reticulated silica. It will be noted that this crucial step of drying the substrate 2, leading to the formation of a solid layer, takes place in the controlled-atmosphere chamber 1, which is continuously flushed by the flow of gas 4, this gas flow taking with it evaporating solvent vapors originating from the film deposited on the substrate 2. The volatile compound vapors liable to be emitted from the surface of the solution 13 contained in the tank 10 cannot modify/alter the atmosphere of the chamber 1, since the solution 13 is removed from the chamber as soon as the submersion of the substrate 2 has finished.

It has been observed that the layers thus obtained are particularly uniform in terms of their physicochemical properties, and that they, in particular, have a very uniform thickness.

The invention is not limited to the examples described above, and it encompasses any variant that falls within the scope of the claims. It is thus possible, as an alternative to the embodiment shown in the figures, for the substrate 2 and the enclosure that contains it to move relative to the solution 13. It is also possible for the solution 13 to remain in the enclosure, provided it is isolated during the drying of the layer, by a retractable wall for example, or even for the solution 13 and the substrate 2 to be located in two enclosures that communicate via a tunnel or loadlock. It is also possible not to move the tank 10 and instead simply to suck the solution 13 contained in the tank 10 out of the enclosure before drying the substrate 2. It is also possible for the relative movement between the tank 10 and the substrate 2 to be a horizontal movement in translation or a combination of translations and rotations.

Although here the process only comprises steps of submerging and drying the substrate 2, the process may also comprise a step of treating the layer, formed by submerging the substrate in the solution 13, directly in the enclosure. For example, the layer will possibly be treated during and/or after drying, especially with a chemical-vapor and/or high-temperature treatment.

It will be noted that the process according to the invention makes provision for the deposition enclosure to be heated by a flow of gas heated beforehand, but, alternatively, it is also possible to choose to heat the chamber directly, which may contribute to reducing effects related to convection of the gas inside the enclosure.

The invention is advantageous in more than one respect: it is particularly suited to depositing layers from aqueous solutions, thereby contributing to reducing the appearance of dewetting effects associated with the high surface tension of aqueous solvents. The invention also allows the appearance of possible phase separations during deposition of layers using solutions containing compounds that are soluble in the solvent but immiscible once the solvent has evaporated, to be reduced. It also allows the atmosphere in which the layer is deposited and dried to be chosen and controlled with precision, and enables many different types of treatment to be carried out on the layer.

The invention claimed is:

1. A process for depositing a layer on at least part of a surface of a substrate by at least partially submerging the substrate in a solution comprising a solvent and at least one compound intended to form the layer, then drying the substrate, the drying being carried out at least partially in a controlled atmosphere enclosure that is isolated from the solution, wherein the submersion in the solution and the drying of the substrate are carried out in the same controlled-atmosphere enclosure; and wherein the solution is introduced into the controlled-atmosphere enclosure in order to allow the substrate to be submerged, and is removed from the controlled-atmosphere enclosure during the drying of the substrate.

2. The process as claimed in claim 1, in which the solution is contained in a moveable tank so as to be introduced into the enclosure and removed from the enclosure.

3. The process as claimed in claim 1, in which the atmosphere in the enclosure is controlled by arranging for a flow of gas to pass through the interior of said enclosure.

4. The process as claimed in claim 3, in which the through-flow of gas is heated.

5. The process as claimed in claim 3, in which the through-flow of gas is heated before the gas enters the controlled-atmosphere enclosure.

6. The process as claimed in claim 1, in which treatments are carried out on the layer, directly in the enclosure, at least one of during drying or after drying.

7. A device for implementing the process as claimed in claim 1, comprising:

the enclosure;

means for holding the substrate inside the enclosure;

a mechanism for introducing the solution into the enclosure and removing said solution therefrom, the mechanism comprising;

a tank for receiving the solution, the tank being moveably mounted relative to the enclosure so as to enter therein and exit therefrom, and means for passing the tank through the wall of the enclosure in order to allow the tank to enter and exit via these passing means; and means for controlling the atmosphere inside the enclosure.

8. The device as claimed in claim 7, in which the means for passing comprise at least one trap door that is pushed open by the tank during the introduction of the tank into the enclosure and that automatically closes during the removal of the tank.

9. The device as claimed in claim 7 to form a layer of $SiO_2$ sol-gel on a glass substrate.

10. The process as claimed in claim 1 to form a layer of $SiO_2$ sol-gel on a glass substrate.

11. The process as claimed in claim 1, in which at least one of a high-temperature treatment or a chemical-vapor treatment is carried out on the layer, directly in the enclosure, at least one of during drying or after drying.

12. The process as claimed in claim 1, wherein the process is carried out using a device comprising:

the enclosure;

means for holding the substrate inside the enclosure;

a mechanism for introducing the solution into the enclosure and removing the solution therefrom; and means for controlling the atmosphere inside the enclosure.

13. The process as claimed in claim 1, wherein the moveable tank is removed from the enclosure by moving the tank in translation relative to the enclosure.

14. A process for depositing a layer on at least part of the surface of a substrate by at least partially submerging the substrate in a solution comprising a solvent and at least one compound intended to form the layer, then drying the substrate, the drying being carried out at least partially in a controlled atmosphere enclosure that is isolated from the solution, wherein the submersion in the solution and the drying of the substrate are carried out in the same controlled-atmosphere enclosure; and wherein the substrate is glass and the layer deposited on the substrate by the process is a $SiO_2$ sol-gel layer.

* * * * *